United States Patent [19]

College et al.

[11] 4,083,605

[45] Apr. 11, 1978

[54] RIPPER TOOTH

[75] Inventors: Michael A. College, Everett; Clyde G. Hutzell, Schellsburg; Charles A. Lane, Brownsville; Robert J. McKenry, Windber, all of Pa.

[73] Assignee: Kennametal Inc., Latrobe, Pa.

[21] Appl. No.: 698,769

[22] Filed: Jun. 22, 1976

[51] Int. Cl.[2] ..... E02F 3/80

[52] U.S. Cl. ..... 299/91; 37/142 R; 175/410; 299/36

[58] Field of Search ..... 299/36, 91, 92, 94; 37/141 T, 142 R, 193; 172/765, 772, 699; 175/410

[56] References Cited

U.S. PATENT DOCUMENTS

| | | | |
|---|---|---|---|
| 1,815,649 | 7/1931 | Edmunds | 37/142 R |
| 2,623,309 | 12/1952 | Frye | 37/142 R |
| 3,805,423 | 4/1974 | Engle et al. | 37/142 R |
| 3,932,952 | 1/1976 | Helton et al. | 175/410 |

FOREIGN PATENT DOCUMENTS

| | | | |
|---|---|---|---|
| 547,987 | 10/1922 | France | 172/772 |

*Primary Examiner*—Ernest R. Purser
*Assistant Examiner*—William F. Pate, III
*Attorney, Agent, or Firm*—Lawrence R. Burns

[57] ABSTRACT

A ripper tooth design is disclosed herein for use with a ripper machine wherein the ripper tooth comprises a generally U-shaped steel body when viewed in side view having a forward working end for engagement with rock formations to be broken and a rearward portion having a recess therein which is adapted for attachment to a shank, which is supported by the ripper machine. The ripper tooth according to the present invention has generally parallel side walls near its rearwardmost portion when viewed in plan, the side walls near the forward portion tapering inwardly toward the center axis of the ripper tooth. A blunt section is formed which extends generally around the front working portion of the generally U-shaped tooth and compacts of hard wear resistant material are imbedded therein to provide a longer working life for the ripper tooth.

3 Claims, 5 Drawing Figures

RIPPER TOOTH

BACKGROUND OF THE INVENTION

Ripper teeth are commonly used in conjunction with earthworking machines which are advanced along the surface of the earth and have an arm that extends downwardly into the earth with a shank being located on the lower end of the arm of the earthworking machine such that a ripper tooth may be mounted on the shank.

Generally, the ripper tooth mounted on the shank is positioned such that it has a forward portion extending in the direction of advance of the earthworking machine on the surface such that advancing the machine on the surface causes the ripper tooth to compress and shatter the rock-like formations beneath the surface thereby forming a narrow trench along the path taken by the earthworking machine.

Such ripper teeth usually form very narrow recesses in the earth formation with the depth of the recess being a multiple of its width with the depth usually being in the range of about three feet, but being able to vary from the three feet, depending upon the circumstances.

Ripper teeth that are known are generally V-shaped in side view having a pointed forward section for initial penetration into the earth material but have a flat side when viewed in plan such that the rock-like material, once shattered, is urged upwardly from the recess being formed in the earth formation.

Generally, the environment in which the ripper teeth must survive is of a very hostile and abrasive nature with compressive pressures of up to about 18,000 pounds per square inch of compression necessary to shatter the rock and, further, the type of rock being of a slag-like material producing extreme wear upon the ripper teeth used for shattering slag.

In addition, the ripper tooth, although generally used by forcing the tooth along a path parallel to the surface of the earth and in the direction of the advancing machine, the ripper tooth assembly and shank may also be pivoted by the arm of the ripping machine such that the angle of attack of the tooth ranges from parallel up to 110 degrees negative rake with the above-mentioned parallel direction of the machine.

Typically, the ripper teeth of the prior art are made of a steel material or the like and are consumed in a very rapid fashion such that large inventories of these teeth must be kept on hand at the site of the excavation and frequently changed. While the ripper teeth are attached by a pin providing a rather rapid, quick release and/or attachment, depending on whether one is removing the tooth or replacing the worn tooth, there is still down time of the machine required, and somewhat of a logistics problem to maintain the inventory of ripper teeth on the site during excavating.

It is an object of the present invention to provide a ripper tooth which is easily adaptable either to be attached to the worn ripper tooth already existing on the machine and provide a substantially longer wear life when in use by said ripping machine.

It is a further object of the present invention to provide a ripper tooth having a substantially longer wear life than heretofore previously known and which is easily attachable to the existing shank of the ripping machine thereby requiring less of an inventory of ripper teeth to be kept on site at an excavation project and further preventing any excessive down time necessary for the changing of said ripper teeth.

BRIEF SUMMARY OF THE INVENTION

According to the present invention, a ripper tooth assembly is described which has a generally U-shaped configuration when viewed from the side and having a forward working portion for engagement with the rock material and a rearward portion for engagement with a support member extending from the body of the ripper machine. The rearward portion of the generally U-shaped body has a recessed form therein which is adapted for attachment either by welding onto the worn ripper tooth already existing on the machine or by a telescopic engagement over the shank on the ripping machine with a releasable pin mechanism holding the ripper tooth onto the shank.

The forward working portion of the ripper tooth is generally U-shaped when viewed from the side, but when viewed in plan, has generally parallel side walls extending forwardly from the rearward portion with the side walls converging towards the center axis of the ripper tooth and terminating in a generally blunt section which preferably comprises flat planar sections which extend around the U-shaped portion of the ripper tooth.

Compacts of hard wear resistant material, preferably, a tungsten carbide material are imbedded in bores formed and spaced along the blunt section of the ripper tooth. The converging side walls of the ripper tooth are of a planar nature when tapering inwardly from the generally parallel side walls to the blunt section. Compacts of the hard wear resistant material may also be, preferably, placed and fixedly held in bores formed in at least one converging side walls so as to prevent excessive wear of the side walls.

Advantageously, the ripper tooth of the present invention, since it is generally U-shaped in side view, and has converging side walls when viewed in plan, provides a wedging type action outwardly in two directions as the ripper tooth is advanced through the rock-like formations. Advantageously, also, is the fact that the blunt section, as mentioned above, will tend to wear during use to a sharper configuration as the parent material around the compacts is abraded away, thereby producing a more efficient ripper tooth.

The exact nature of the present invention will become more clearly apparent upon reference to the following detailed specification taken in connection with the accompanying drawings in which.

DETAILED DESCRIPTION OF THE INVENTION

Figure 1:
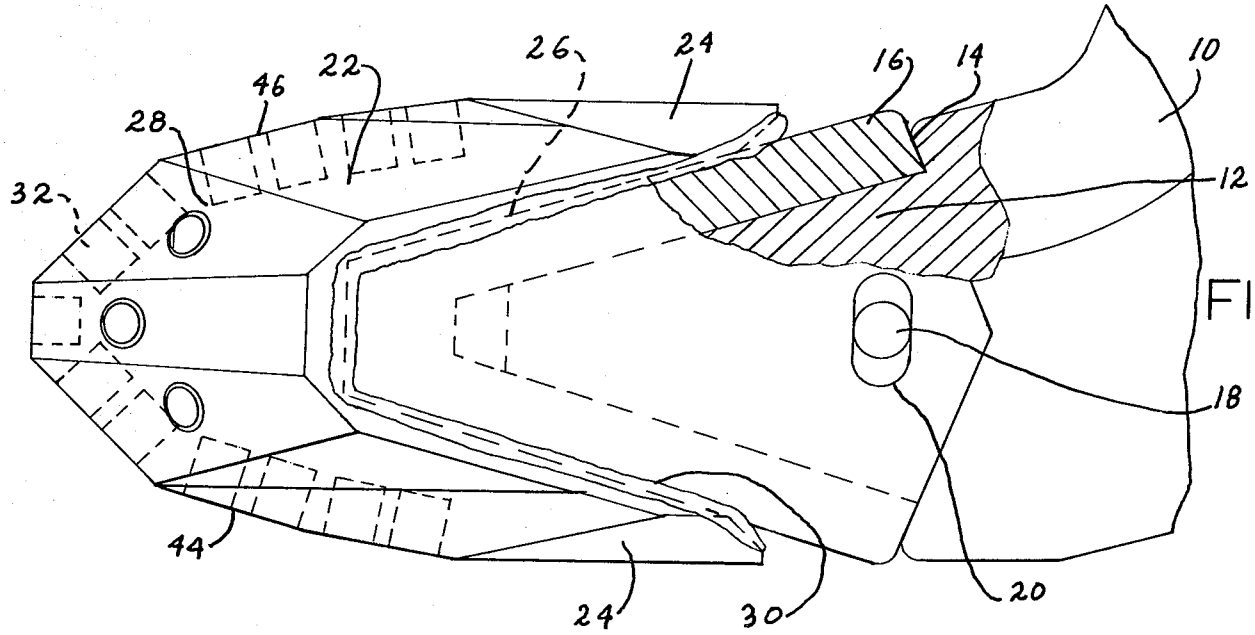
FIG. 1 is a side view of the ripper tooth according to the present invention as it is adapted to be attached to a worn ripper tooth already existing on the machine.
Figure 5:
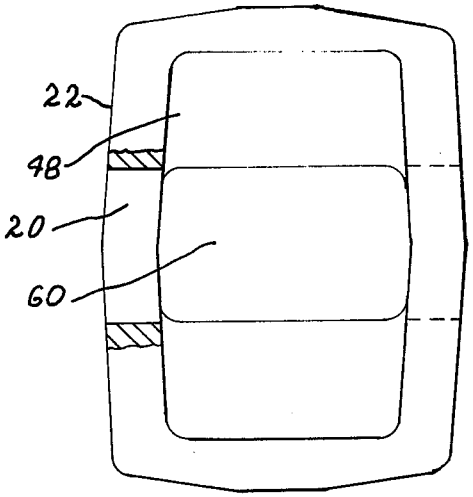
Figure 3:
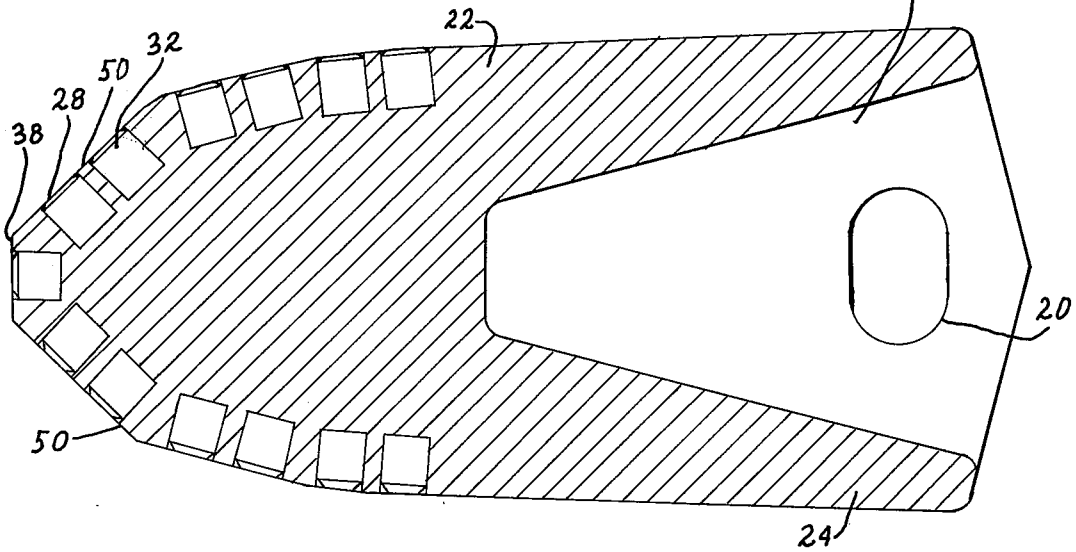
Figure 4:
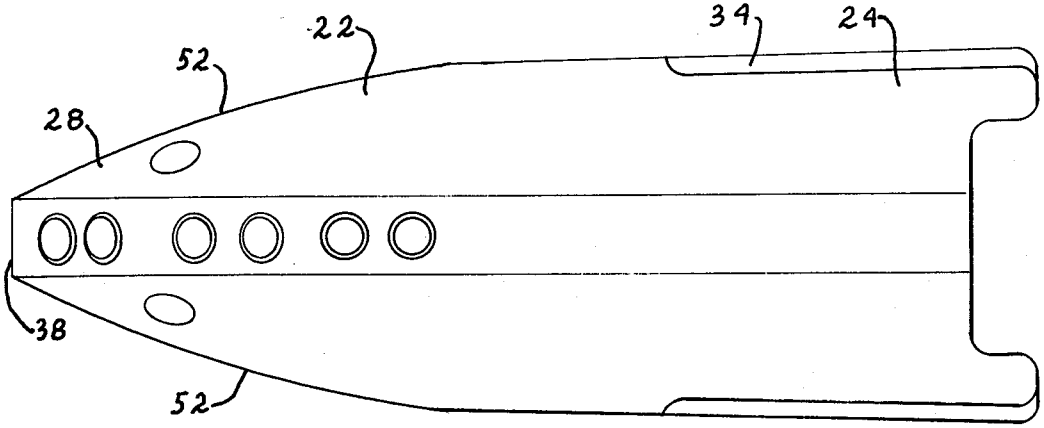

Referring to the drawings somewhat more in detail, what is shown therein is lower end 10 of a pivotal arm which is attached on its upper end to the earthworking or ripping machine which is positioned on the surface of the earth and which is generally advancing in a direction towards the left of FIG. 1.

The end portion 10, as mentioned above, is pivotal on an arm extending from the machine and is adjustable such that a desired depth below the earth surface may be achieved and, also, the angle of attack of the ripper tooth may be varied depending upon the requirements of the excavation to be formed.

As pictured in FIG. 1, lower end 10 is shown pointed in a direction generally parallel of the advance of the earthworking machine which is not shown. As is shown in FIG. 1, lower member 10 has attached to it a shank 12 which is generally V-shaped and has upper and lower surfaces which generally taper inwardly in the forward direction with the shank 12 being formed from a portion of the lower member 10.

A shoulder 14 extends from around the shank 12 at its rearwardmost section such that a steel ripper tooth 16 is telescopically engaged over the shank 12 until it abuts shoulder 14 and then a transverse pin 18 is inserted through a perforation 20 and a further transverse hole existing in the shank 12 such that pin 18 releasably holds steel ripper tooth 16 onto shank 12.

The ripper tooth 22 according to the present invention is shown having a rearward portion 24 with a recess 26 formed through the side walls thereof such that recess 26 tapers inwardly from the rearmost edge of portion 24 towards the forward portion 28 of ripper tooth 22.

As shown in FIG. 1, ripper tooth 22 is fastened by telescopically engaging the recess 26 over a forward end of worn steel ripper tooth 16 and forming a weld 30 between the innermost part of the recess 26 of ripper tooth 22 and the outermost portion of steel ripper tooth 16. Shown on the forward working portion 28 of the ripper tooth 22 are compacts of hard wear resistant material 32 imbedded therein and spaced along the generally U-shaped configuration of the forward working portion 28.

Figure 2:
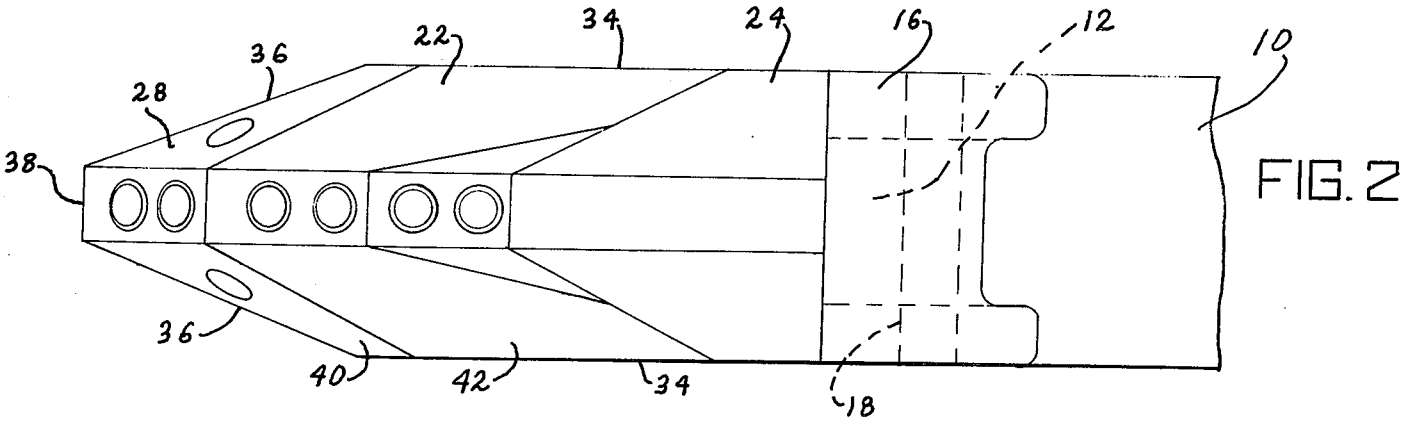
FIG. 2 is a plan view of the ripper tooth according to FIG. 1.

Referring now to FIG. 2, what is shown therein is the ripper tooth assembly as shown in FIG. 1 when looking at the assembly in plan view. The rearwardmost member of FIG. 2 shows the lower end 10 in connection with the shank 12 having the worn steel ripper tooth 16 attached thereto. The rearward portion 24 of ripper tooth 22 is shown having generally parallel side walls 34 which extend from the rearward portion 24 toward the forward portion 28 of ripper tooth 22.

Out near the forward portion 28, the further side walls 36 are shown tapering inwardly from the generally parallel side walls 34 and terminating near the axis of the ripper tooth 22 in a blunt section 38 which is preferably flat and extends generally the length of the U-shaped configuration of ripper tooth 22.

It will be noted that the side walls 36 in this particular case are shown being formed in planar sections such as sections 40 and 42 which have different angles of inclination and, therefore, form different planes having an angular relation one to the other.

It is to be noted, with reference back to FIG. 1, that it should be mentioned that there is a lower side 44 of ripper tooth 22 which is generally subjected to the most pressure and wear and, when the lower section 44 becomes worn, the ripper tooth assembly may be detached from the shank 12 by the removal of pin 18 and the ripper tooth 22 may, then, be inverted such that the upper side 46 is then placed in lowermost position.

Modifications may be made within the scope of the appended claims.

What is claimed is:

1. A ripper tooth for an excavating machine comprising; a tooth member having a forward working portion and a rearward portion, said rearward portion having a recess adapted for attachment to an excavating machine, said forward working portion having a generally U-shaped peripheral region when viewed in side, said peripheral region comprising planar sections facing outwardly from the central axis of the ripper tooth and forming a blunt section when viewed in side and plan, and when viewed in plan said blunt section is bounded by angularly related planar side walls tapering outwardly of said blunt section and outwardly rearwardly of said forward working portion, and rod-like cemented hard metal carbide compacts imbedded in a distributed relation for most of the length around said blunt section viewed in side and having cemented hard metal carbide imbedded in a spaced relation in at least one of said planar side walls.

2. A ripper tooth according to claim 1 in which said tooth is symmetrical about its center line when viewed in side and is adapted to be inverted when said tooth becomes worn on its lower side.

3. A ripper tooth according to claim 2 in which said cemented hard metal carbide material comprises a tungsten carbide material.

* * * * *